US007465113B2

(12) United States Patent
Gueret

(10) Patent No.: US 7,465,113 B2
(45) Date of Patent: Dec. 16, 2008

(54) APPLICATOR INCLUDING A SHEATH

(75) Inventor: Jean-Louis H. Gueret, Paris (FR)

(73) Assignee: L'Oréal S.A., Paris (FR)

( * ) Notice: Subject to any disclaimer, the term of this patent is extended or adjusted under 35 U.S.C. 154(b) by 493 days.

(21) Appl. No.: 11/059,555

(22) Filed: Feb. 17, 2005

(65) Prior Publication Data

US 2005/0196220 A1 Sep. 8, 2005

Related U.S. Application Data

(60) Provisional application No. 60/551,808, filed on Mar. 11, 2004.

(30) Foreign Application Priority Data

Feb. 17, 2004 (FR) ..... 04 50290

(51) Int. Cl.
*A46B 11/00* (2006.01)

(52) U.S. Cl. ..... 401/129; 401/126; 15/168; 15/191.1; 15/207.2; 15/DIG. 6

(58) Field of Classification Search ..... 401/120, 401/126, 128, 129, 130, 283, 284; 15/168, 15/169, 191.1, 195, 207.2, DIG. 5, DIG. 6
See application file for complete search history.

(56) References Cited

U.S. PATENT DOCUMENTS 752,078 A * 2/1904 Burt et al. ..... 401/276
2,791,789 A * 5/1957 Smith et al. ..... 401/119
3,739,789 A 6/1973 Cataneo et al.
4,841,996 A 6/1989 Gueret
4,854,759 A 8/1989 Morane et al.
5,121,763 A * 6/1992 Kingsford ..... 132/317
5,357,647 A 10/1994 Gueret
5,588,447 A 12/1996 Gueret
5,620,270 A * 4/1997 Gueret ..... 401/126
6,033,143 A 3/2000 Gueret
6,450,717 B1 * 9/2002 Salz et al. ..... 401/125
6,969,210 B1 * 11/2005 Newell ..... 401/284

FOREIGN PATENT DOCUMENTS

EP 0 556 081 A1 8/1993
EP 0 651 955 A1 5/1995
FR 2 155 688 5/1973
WO WO 01/76408 A1 10/2001

* cited by examiner

*Primary Examiner*—David J Walczak
(74) *Attorney, Agent, or Firm*—Finnegan, Henderson, Farabow, Garrett & Dunner, LLP

(57) ABSTRACT

An applicator for applying a substance includes an applicator element (e.g., bristles). In some examples, the applicator may include a bundle of bristles having at least one of bristles of at least two kinds, bristles of non-circular cross-section, and bristles that are not rectilinear. The applicator may also include a stem supporting the bundle of bristles, and a sheath cooperating with the stem over at least a fraction of a length of the stem to form a space configured to contain a portion of a substance to be applied.

70 Claims, 8 Drawing Sheets

APPLICATOR INCLUDING A SHEATH

This application claims the benefit under 35 U.S.C. § 119 (e) of U.S. Provisional Application No. 60/551,808, filed on Mar. 11, 2004.

The present invention relates to applicators for applying a substance. In particular, various exemplary embodiments of the present invention relate to applicators for applying cosmetic products, such as nail varnish. The term "cosmetic product" includes care products.

There are various applicators for applying a substance to nails, which comprises a mixture of bristles. For example, European Patent Application No. EP-A-0 556 081 discloses a brush for applying a varnish to nails, where the brush comprises a mixture of bristles of different diameters. European Patent Application No. EP-A-0 651 955 also discloses a brush for applying varnish to nails. The brush comprises two kinds of bristles having different mechanical properties in order to form relatively large gaps between the bristles. Furthermore, U.S. Pat. No. 4,841,996 discloses an applicator device for applying a viscous liquid, such as nail varnish. The device includes an applicator brush and a reservoir suitable for storing the liquid therein so as to feed the applicator brush with the liquid stored in the reservoir when the applicator brush is removed from the receptacle containing the liquid.

However, there still exists a need for further improving the performance of an applicator for applying a substance to a particular region of the body, such as, for example, the face or the nails. In particular, there is a need for further improving the performance of an applicator with respect to the amount of cosmetic product to be carried by the applicator.

Although the present invention may obviate one or more of the above-mentioned needs, it should be understood that some aspects of the invention might not necessarily obviate one or more of those needs.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the present invention may include an applicator for applying a substance to, for example, nails. The applicator may comprise a bundle of bristles comprising at least one of bristles of at least two kinds, bristles of non-circular cross-section, and bristles that are not rectilinear. The applicator may also comprise a stem supporting the bundle of bristles, and a sheath cooperating with the stem over at least a fraction of a length of the stem to form a space configured to contain a portion of a substance to be applied.

As used herein, the term "bristles of at least two kinds" means at least two bristles which differ from one another in their compositions, shapes (e.g., longitudinal profile-and axial cross-section), and/or dimensions other than lengths (e.g., when the only difference between at least two bristles is their lengths, the bristles are not at least two kinds of bristles).

The term "bristles that are not rectilinear" means bristles that are non-rectilinear along at least a portion of their length extending from the stem to the bristle free ends. For example, the bristles disclosed in U.S. Pat. No. 4,841,996 ("'996 Patent") do not constitute "bristles that are not rectilinear" since each of the bristles of the '996 Patent is substantially rectilinear over its entire length from a stem to its free end.

The bundle of bristles comprising bristles of at least two kinds and/or bristles, of non-circular cross-sections may increase the capillary retention capability (e.g., substance-retention) of the bundle as compared to a bundle of bristles of only a single kind and/or only circular cross-sections.

According to another aspect of the invention, the duration of applicator use between refills or reloads of the applicator may be increased without compromising or affecting the application quality. This may be achieved by the presence of a substance reservoir in the applicator that is configured to contain a substance and/or by having a bundle of bristles comprising bristles of at least two kinds, bristles of non-circular cross-section, and/or bristles that are not rectilinear. In some exemplary embodiments, the reservoir may be formed by a space between the sheath and the stem. Additionally or alternatively, the space may be formed between the sheath and the bundle of bristles.

With enhanced capillary retention capability of the bundle, the bundle of bristles may prevent the substance contained in the space from flowing too quickly, for example, to a body part to be treated. As a result, it may be possible to use less viscous substance without fear of the substance being expelled too quickly. Thus, one or more exemplary embodiments of the invention may enable a user to regulate the delivery of the substance carried by the applicator and to increase the application duration without compromising the application quality.

In one aspect of the invention, the bundle of bristles may comprise at least two bristles comprising compositions that are different from one another. The composition of bristles in a bundle may depend on the rheology of the substance. Using mixed bristles of different compositions may allow the applicator to be adapted relatively easily to the rheology of the substance by, for example, adjusting the relative proportions of each bristle type in the bundle.

According to still another aspect, the bundle of bristles may comprise bristles of at least two kinds having properties that may cause the bundle to expand, thereby forming many gaps between the bristles where the substance may be retained by capillarity.

In another aspect, the bundle of bristles may comprise at least two bristles having dimensions that are different from one another. For example, the bundle of bristles may comprise at least two bristles having lengths and/or greatest transverse dimensions that are different from one another. In some exemplary embodiments, one of the at least two bristles may have a length more than 10%, 20%, or 30% greater than a length of another of the at least two bristles. Alternatively or additionally, one of the at least two bristles may have a greatest transverse dimension (e.g., a diameter) more than 15% greater than a greatest transverse dimension of another of the at least two bristles.

In some aspects, the bundle of bristles may comprise at least two bristles having shapes that are different from one another. For example, one of the at least two bristles may have a longitudinal profile that is different from a longitudinal profile of another of the at least two bristles. Alternatively or additionally, one of the two bristles may have a cross-section that is different from a cross-section of another of the at least two bristles.

For example, the bundle of bristles may comprise at least one straight bristle and at least one undulating bristle. According to various exemplary embodiments, a percentage of straight bristles in the bundle may range from about 60% to about 80% (e.g., about 70%), and a percentage of undulating bristles in the bundle may range from about 20% to about 40% (e.g., about 30%).

According to another aspect, the bristles in the bundle may also comprise undulating bristles having periodic patterns that are different from one another. The term "periodic pattern," as used herein, is intended to designate a portion of the bristle which is substantially reproducible in periodic manner along the bristle. In an exemplary embodiment, a periodic pattern of a bristle may comprise any combination and/or repetition of an undulation, a filler, a variation in the bristle cross-section, a notch, and a relief portion.

A periodic pattern presenting at least one undulation may be characterized by three components: shape (e.g., sinusoidal or sawtooth); amplitude (i.e., size measured in a direction orthogonal to the general longitudinal direction of the bristle); and spatial frequency (i.e., the number of patterns reproduced per unit length of the bristle). A single pattern may be repeated several times over the full length of the bristle. A bristle may present one single pattern or less than one single pattern.

According to another aspect, each of the at least two kinds of bristles may have a number of bristles representing at least 2% of the total number of bristles in the bundle. In various exemplary embodiments, each of the at least two kinds of bristles may have a number of bristles representing at least 5%, 10%, 20%, 30%, or 40% of the total number of bristles in the bundle. In some exemplary embodiments, the bundle may comprise bristles of two kinds in substantially equal proportions.

In still another aspect, a bundle of bristles may comprise at least one bristle having properties that enhance or facilitate sliding.

In yet still another aspect, the bundle of bristles may have a variety of different cross-sectional shapes (e.g., rectangular, circular, oval, etc.). When the bundle of bristles is flat, the bundle may be oriented such that the elongation axis may be substantially parallel or perpendicular to the lateral opening in the sheath.

In some aspects, the sheath may cooperate with the stem only to form the space enabling a substance to be stored. Alternatively, the sheath may cooperate with both the bundle of bristles and the stem to form the space.

According to an aspect, the space may be arranged such that the substance may fill the space when the sheath is immersed in the substance, for example.

In some aspects an air vent may be provided in the sheath (e.g. in the form of at least one opening in the sheath). An air vent may also be provided in the mounting configuration between the applicator and the sheath. For example, a vent may be formed between the top edge of the sheath and the portion of the applicator to which the sheath may be secured. Alternatively or additionally, a vent may be formed through the portion of the applicator on which the sheath may be mounted.

According to various aspects, the space between the sheath and the stem may be arranged such that the substance may be retained in the space by capillarity. Where appropriate, the space may be relatively wide, at least in some regions, with a gap of more than 2 millimeters (mm), for example, between the inside surface of the sheath and the portion of the stem or the bundle of bristles that faces the inside surface of the sheath. The movements of the bundle of bristles and/or the stem during application may create local variations in the gap, thereby affecting the flow of substance.

In some aspects, the sheath may include at least one lateral opening enabling a flow communication between the space and an outside of the sheath, so as to enable a substance to enter into the space and/or to permit air to flow in and out of the space. This may make it easier for the space to be filled with the substance and/or for the substance to flow out of the space towards the bundle of bristles. In various exemplary embodiments, the lateral opening may extend over at least about 5 square millimeters ($mm^2$). For example, the opening may extend over at least about 9 $mm^2$, 16 $mm^2$, 20 $mm^2$, or 25 $mm^2$.

In various aspects, the sheath may be rigid or flexible. The sheath may also be made of a material that is different from a material of the stem. In a variant, the sheath may be made of the same material as the stem.

According to one aspect, the sheath may comprise an inside surface and/or an outside surface that may be completely smooth over at least a fraction of its length. For example, the sheath may have no annular flange and/or groove on its inside surface. By way of example, the inside surface of the sheath may be smooth, and the stem may include relief portions (e.g., ribs or other roughnesses). In a variant, the sheath may comprise an inside surface that may include at least one relief portion, such as, for example, ribs (e.g., annular ribs).

In various aspects, the sheath may be secured to the stem by stapling. Alternatively or additionally, the sheath may be attached to the stem by snap-fastening. It should be understood, however, that the sheath may be secured to the stem by any other mechanism know in the art. For example, the sheath may be attached to the stem by adhesive bonding, heat-sealing, and/or friction-fitting. The sheath and the stem may be integrally formed as a single piece (e.g., by injection molding of material or by overmolding).

According to another aspect of the invention, the sheath may comprise a circular cross-section over at least a fraction of its length. Alternatively, the sheath may comprise an oblong cross-section over at least a fraction of its length. The cross-sectional shape of the sheath may depend on, for example, whether the cross-section of the stem is circular or oblong. For example, the sheath may comprise a circular cross-section while the stem may have an oblong cross-section, or vice versa. In an exemplary embodiment, the outside profile of the sheath may be constant along its length. The sheath may have a cross-section that may vary along its length. For example, the sheath may comprise an inside cross-section that may be circular at one axial end and that is flat at the other axial end. The inside cross-section may vary from a circular cross-section at one axial level to an oblong cross-section at another axial level.

The sheath may comprise an inside section that tapers towards the bundle of bristles. Where appropriate, the cross-sections of the sheath and the stem may be substantially similar, e.g. both being oblong over at least a fraction of their length.

In still another aspect, the receptacle may comprise a neck comprising a free edge forming a sharp edge. The sheath may present a free edge adjacent to the bundle of bristles, which may be completely circular. The sheath may comprise a notch at a free end to guide the flow of substance onto the center of the applicator element and/or to make it easier for the substance to flow towards the applicator element.

The stem may comprise a cross-section that is circular or oblong over at least a fraction of its length. In: particular, the stem may have a cross-sectional shape that tends to channel the substance flowing along the stem towards a predefined region of the bundle of bristles.

According to an aspect, at least a portion of the stem adjacent to the bundle of bristles may comprise a cross-section having an outer profile that includes at least one depression.

In another aspect, the stem may comprise a housing configured to receive the bundle of bristles, and the bundle of bristles may be secured to the housing. The housing may have an opening of oblong cross-section with a long axis, and the oblong cross-section may have a depression substantially mid-way along the long axis of the housing. In some exemplary embodiments, the sheath may comprise an inside cross-section that may vary.

In still another aspect, the stem may comprise two depressions or grooves situated opposite to each other along at least a fraction of its length. The depressions or grooves may guide the flow of substance to a desired path along the stem.

According to one aspect, an applicator may comprise an applicator element, a stem supporting the applicator element, and a sheath cooperating with the stem over at least a fraction of a length of the stem to form a space configured to contain at least a portion of a substance to be applied. The sheath and the stem may comprise cross-sections arranged such that the space may define a width that varies around the stem over at least a fraction of the length of the stem.

According to another aspect, an applicator may comprise an applicator element other than a brush, a stem supporting the applicator element, a sheath cooperating with the stem over at least a fraction of its length to form a space configured to contain a substance to be applied. In some aspects, the applicator element may be a felt tip or a flocked endpiece.

Still another aspect of the invention may include an applicator for applying a substance, comprising an applicator element (e.g., a bundle of bristles), a stem supporting the applicator element, a sheath cooperating with the stem over at least a fraction of its length to form a space configured to contain a substance to be applied. The sheath may include at least one lateral opening that may enable substance to enter into the space. In some exemplary embodiments, the lateral opening may be greater than 5 $mm^2$. The stem may be prevented from moving in the longitudinal direction relative to the sheath. Such an applicator may be received in a receptacle that includes a neck with an at least partially widened portion that faces the lateral opening.

When the applicator element has a generally flat shape, the sheath and/or the stem may be arranged to channel or guide the substance to a desired path of the applicator element (e.g., center region). For example, the sheath or the stem may include a depression that may be symmetrical about the mid-plane of a housing that holds the applicator element.

The presence of the sheath along at least a fraction of the stem may make it possible to slow down the flow of substance towards the applicator element, so as to obtain a flow rate-that may be adapted to the type of substance to be applied and/or the type of applicator element to be used.

In another aspect, the cross-sections of the sheath and the stem may be different from one another so that the width of the space between the sheath and the stem may vary around the circumference. For example, at least one of the sheath and the stem may have a cross-section having a depression, thereby increasing the width of the space locally.

In still another aspect, at least a portion of the stem adjacent to the applicator element may comprise a cross-section having an outer profile that may comprise at least one depression. For example, the stem may comprise at least one rectilinear groove extending along at least a fraction of the stem. In some exemplary embodiments, the stem may comprise two rectilinear grooves situated opposite to each other. The groove may be non-rectilinear. For example, the groove may be helical.

In some aspects, the cross-section of the sheath may comprise at least one depression. In still another aspect, the sheath may comprise the at least one depression at least in the vicinity of an end of the sheath adjacent to the applicator element.

According to an aspect, the stem or the sheath may comprise a groove. The groove may open out axially at the end of the stem or the sheath adjacent to the applicator element.

In another aspect, the stem or the sheath may comprise a cross-section having at least one depression. The shape of the at least one depression may vary along the length of the stem or the sheath (e.g., depression with or without rounded bottom).

In still another aspect, the stem may comprise a wall of varying thickness around a housing of the stem. The housing may be configured to receive the applicator element.

According to some aspects, the stem may comprise a wall of constant thickness around a housing of the stem, and the housing may be configured to receive the applicator element.

Some aspects of the invention may provide a device for applying a substance (e.g., nails). The device may comprise a receptacle containing the substance to be applied and any of the applicators described above.

In an aspect, the device may further comprise a closure cap supporting the stem, and the receptacle may comprise a neck configured to engage the closure cap. For example, the receptacle may include a threaded neck, and the closure cap may include a threaded mounting skirt configured to be screwed onto the neck.

According to another aspect of the invention, the device may lack a wiper. In some other aspects, the device may further comprise a wiper.

According to still another aspect, the neck may include a free edge that may form a sharp edge. The sharp edge may make it easier to wipe the applicator element. The stem may include a plate having an annular groove with which the sharp edge may engage.

In one aspect, the receptacle may comprise a neck and an add-on piece associated with the neck. The add-on piece may form a sharp edge. In some exemplary embodiments, the add-on piece may be secured to the neck of the receptacle by snap-fastening.

In some aspects, the sheath may comprise at least one lateral opening having an area greater than 9 $mm^2$. The receptacle may comprise a neck having an at least partially widened portion in the vicinity of the lateral opening, so as to make it easier for the substance to flow towards the lateral opening. By way of example, the distance between the lateral opening and a wall of the widened portion may not be less than 1.5 mm.

According to an aspect of the invention, the sheath may define a radial clearance relative to the receptacle when the applicator is in place on the receptacle. By way of example, the clearance may not be less than 0.5 mm. In some exemplary embodiments, a top end of the sheath may comprise an outside diameter that is less than an inside diameter of the neck.

According to another aspect of the invention, the length of the closure cap may be greater than the length of the stem and/or greater than the length of the receptacle. If the closure cap is also used as a handle, a relatively long closure cap may make application more comfortable and enable a user to handle the applicator differently.

In still another aspect, the receptacle may have a relatively long neck. A long neck may reduce the risk of the neck thread becoming clogging by substance that has dried out. A long neck may also enable the closure cap to be made with a mounting skirt that may be sufficiently long to mask the lateral opening formed in the sheath.

In another aspect, the closure cap may comprise a plurality of fins disposed on an inside surface of the closure cap. The fins may serve to secure the stem and/or to receive a tubular-shaped mounting endpiece of the stem.

In still another aspect, the device may further comprise an outer ring secured to an outside surface of the receptacle. The ring may be positioned in such a manner that the level of the liquid inside the receptacle may be kept below the level of the opening of the receptacle when the receptacle rests on horizontal surface via its bottom and the ring.

In one aspect, the device may include a sleeve (e.g., an elastomer sleeve). In some exemplary embodiments, the sleeve may be fitted onto the receptacle and retained thereon by friction. Such a sleeve can make it easier to hold the receptacle.

In another aspect of the invention, a vent may be formed between a top edge of the sheath and a portion of the applicator to which the sheath may be secured.

According to some aspects, the substance contained in the receptacle may be a product to be applied to nails. For example, the product may be a cosmetic product such as nail varnish.

Another aspect of the invention may provide a device for applying a substance. The device may comprise a receptacle containing the substance to be applied and any of the applicators described above. In various exemplary embodiments, the substance contained in the receptacle may be a product to be applied to nails (e.g., a cosmetic product such as nail varnish).

Aside from the structural arrangements set forth above, the invention could include a number of other arrangements, such as those explained hereinafter. It is to be understood, that both the foregoing description and the following description are exemplary.

The accompanying drawings, which are incorporated in and constitute a part of this specification, illustrate a number of non-limiting embodiments of the invention and together with the description, serve to explain the principles of the invention.

Reference will now be made in detail to exemplary embodiments of the invention, examples of which are illustrated in the accompanying drawings. Wherever possible, the same reference numbers will be used throughout the drawings to refer to the same or like parts. It is to be understood that both the foregoing general description and the following detailed description are exemplary and explanatory only and are not restrictive of the invention, as claimed.

Figure 1:
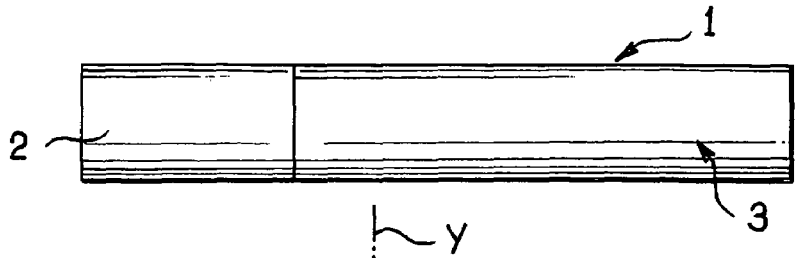
FIG. 1 is a diagrammatic side view of an exemplary device for applying a substance, showing the device in a closed position.
Figure 2:
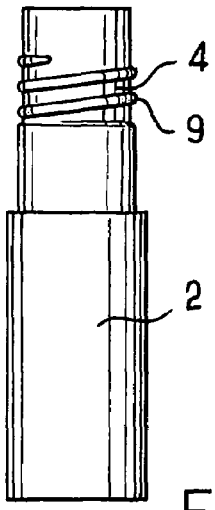
FIG. 2 is a diagrammatic view of the device shown in FIG. 1, showing the device in an open position.
Figure 3:
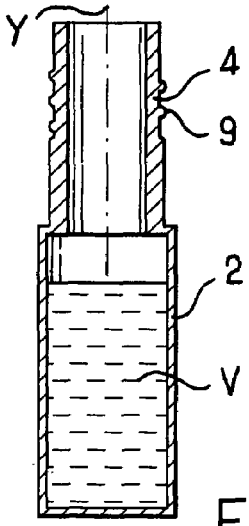
FIG. 3 is a longitudinal cross-sectional view of the device shown in FIG. 2.

The packaging and applicator device 1 shown in FIGS. 1 to 3 may comprise a receptacle 2 and an applicator 3 configured to be secured in a removable manner to the receptacle 2.

In the exemplary embodiment of FIGS. 1 to 3, the receptacle 2 may contain nail varnish V, but the receptacle 2 may contain any other substance, such as, for example, any other cosmetic or care product.

The receptacle 2 may be made of any material that is compatible with the substance contained therein. For example, the material of the receptacle 2 may be made of one or more materials selected from glass; metals; plastics, such as, for example, Barex®; and polyolefins, such as, for example, polyethylene, polyethylene/ethylvinyl alcohol/polycarbonate (PE/EVOH/PC), and polyethylene/ethylvinyl alcohol/nylon® (PE/EVOH/NYLON®). The exemplary materials listed above are by no means intended to limit the scope of the present invention. Instead, they are exemplary only. Any other material known in the art may also be used alternatively or additionally.

In some exemplary embodiments, the receptacle 2 may include, in its top portion, a neck 4 which extends along a longitudinal axis Y. The neck 4 may be provided with an outside thread 9 on which a mounting skirt 17 of a closure cap 5 may be screwed. Any other known securing mechanism may be used alternatively or additionally. The closure cap 5 may also serve as a handle for the applicator 3.

By way of example only, the closure cap 5 may have a length greater than the length of the receptacle 2, as shown in FIGS. 1-3. In some exemplary embodiments, the length of the closure cap 5 may be less than that of the receptacle 2.

At its bottom portion, the applicator 3 may include a stem 6 having an end portion 7 configured to support a bundle 10 of bristles 11. In an exemplary embodiment, the bundle 10 of bristles 11 may comprise bristles of at least two kinds. At its top, the stem 6 may include an endpiece 8 for securing to the closure cap 5 by snap-fastening and/or by friction, for example. In an exemplary embodiment, the endpiece 8 may include a plate 90 arranged to bear against the top end edge of the neck 4 when the closure cap 5 is secured to the receptacle 2.

Referring to FIG. 3, the stem 6 may include a tubular sheath 15 that may surround at least a portion of the stem 6. In the exemplary embodiment shown in FIG. 3, the sheath 15 may extend downwardly beyond the distal end of the stem 6 and surround the bundle 10 of bristles 11 over a fraction of its length. In this configuration, the inside surface 16 of the sheath 15 may cooperate with the stem 6 and the bundle 10 of bristles 11 to define an annular space 20 that may serve as a reservoir of substance to be applied with the applicator 3.

The sheath 15 may include at least one lateral opening 21 configured to communicate with the annular space 20. The lateral opening may open outwardly to face the mounting skirt 17. The mounting skirt 17 may be sufficiently long to cover the lateral opening 21 so as to improve appearance. In a variant (not shown), the mounting skirt 17 may not cover the lateral opening 21, and the lateral opening 21 may be visible from outside.

In the embodiment shown in FIGS. 1-3, the sheath 15 may be flexible, but it may also be rigid.

In some exemplary embodiments, the sheath 15 may be made of a transparent material that may be different from the material of the stem 6.

In an exemplary embodiment, the sheath 15 may have a circular cross-section. The stem 6 may also have a circular cross-section, and its top end may include a widened portion 26 that may be connected to the endpiece 8. In this configuration, the sheath 15 may be configured to bear against the widened portion 26.

Figure 4:
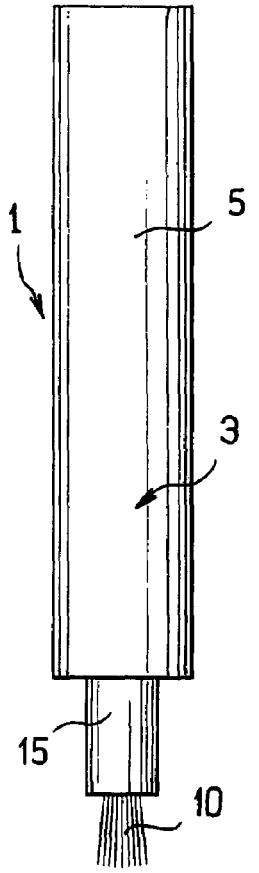
FIG. 4 is a partial cross-sectional view of the device, showing the stem and the sheath of FIG. 3 without the applicator element.
Figure 4:
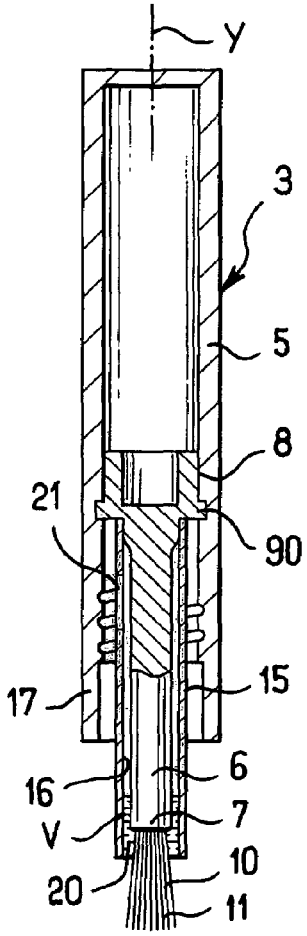
Figure 4:
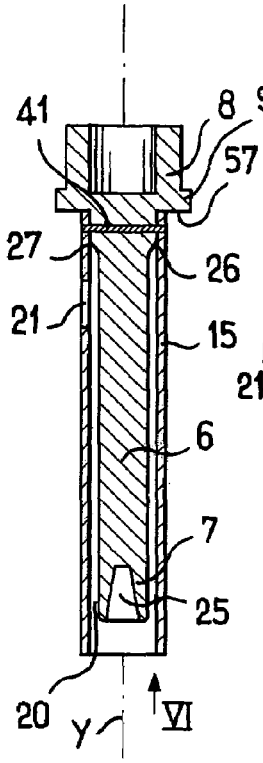
Figure 8:
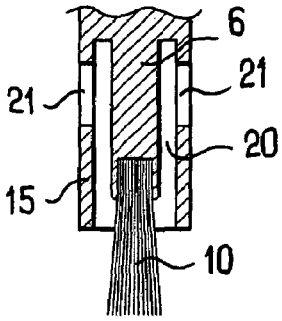
FIG. 8 is a partial cross-sectional view of an exemplary device for applying a substance, illustrating the stem being integrally formed as a single piece with the sheath.

The sheath 15 may be secured onto the stem 6 by, for example, at least one staple 41 inserted into the widened portion 26, as shown in FIG. 4. The staple 41 may be disposed at any other location on the sheath 15. Alternatively or additionally, the sheath 15 may be secured to the stem 6 by adhesion, welding, clamping, snap-fastening, or any other securing mechanism known in the art. In some exemplary embodiments, the sheath 15 may be integrally formed with the stem 6 as a single piece, as shown in FIG. 8. The exemplary embodiment of FIG. 8 also illustrates the possibility of providing more than one lateral opening 21 on the sheath 15, e.g. two diametrally opposed openings 21.

As shown in FIG. 4, the end portion 7 of the stem 6 may include a housing 25 arranged to receive the bundle 10 of bristles 11. The bundle 10 may be secured to the end wall of the housing 25 by, for example, stapling. The bundle 10 of bristles 11 may be folded in half, for example, and secured mid-way along the length of the bristles 11 by a staple (not shown) inserted into the end wall of the housing 25.

Of course, the bundle 10 of bristles 11 may be secured to the stem 6 by any means other than the stapling. For example, the stem 6 may be injection-molded with the bristles 11, or the bristles 11 may be adhesively bonded to the stem 6.

Figure 5:
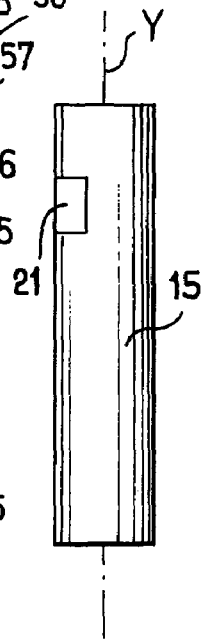
FIG. 5 is a schematic diagram showing the sheath shown in FIG. 3.

In some exemplary embodiments, the lateral opening 21 may have a polygonal cross-sectional shape, such as, for example, a square or a rectangle, as shown in FIG. 5. The lateral opening 21 may be large enough to permit the substance V to flow therethrough easily. By way of example only, the cross-sectional area of the lateral opening 21 or the sum of the cross-sectional areas of the lateral openings 21, if more than one, may exceed 5 $mm^2$, and preferably 9 $mm^2$ or 16 $mm^2$. The cross-sectional area may be even greater than 20 $mm^2$ or 25 $mm^2$. In the exemplary embodiment shown in FIG. 5, the lateral opening 21 has a side of approximately 5 mm.

Before application, the receptacle 2 may be shaken with the closure cap 5 secured thereon, thereby causing substance V to penetrate into the annular space 20 through the lateral opening 21.

When the applicator 3 is removed from the receptacle 2 to apply the substance V, the substance V penetrated into the space 20 may remain in the space 20, as shown in FIG. 3. The bundle 10 may have increased capillary retention capability as a result of using bristles of at least two different kinds, which may prevent the substance V contained in the space 20 from flowing too quickly while being applied. Thus, the applicator 3 may enable a user to extend the use-time between refills. For example, a user may apply varnish to one or more nails in a single load of varnish without having to dip the applicator 3 back into the receptacle 2.

The flow rate of the substance V may be controlled more easily, making it possible, if so desired, to apply a relatively thick layer of substance, for example.

The bundle 10 of bristles 11 may include at least two bristles 11 having mechanical properties that are different from one another. For example, the at least two bristles 11 may have different bending along their lengths, thereby making it possible to obtain a bundle 10 of bristles 11 that are spaced well apart with gaps between the bristles 11 that are capable of retaining the substance V by capillarity.

The bundle 10 of bristles 11 may also include bristles 11 having a non-circular cross-section. Such bristles 11 may have an increased substance-retention capability.

Figure 7:
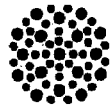
FIG. 7 is a schematic diagram showing the end of the bundle of bristles of the device shown in FIGS. 1 to 3.

In the exemplary embodiment shown in FIG. 7, the bundle 10 of bristles 11 may include at least two bristles 11 having diameters that are different from one another.

Figure 9:
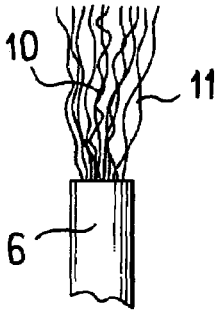
FIG. 9 is a partial schematic view of an exemplary device, showing a bundle of bristles comprising at least two kinds of bristles whose axial profiles are different from one another.

Alternatively or additionally, the bundle 10 of bristles 11 may include at least two bristles 11 having different undulating patterns that may differ in shape, spatial frequency, and/or amplitude, as shown in FIG. 9.

Figure 10:
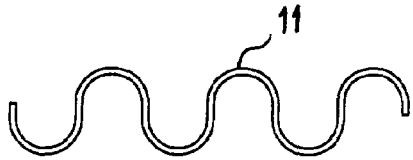
FIGS. 10 and 11 are schematic diagrams illustrating exemplary patterns of undulating bristles.
Figure 11:
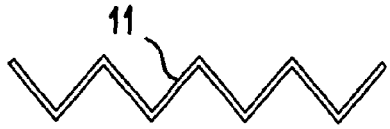

FIGS. 10 and 11 show two examples of undulating bristles 11. The bristle 11 in FIG. 10 presents a substantially sinusoidal shape, while the bristle 11 shown in FIG. 11 presents a saw-tooth shape.

The bundle 10 may also comprise undulating bristles 11 or straight bristles 11. For example, the percentage of undulating bristles 11 may range from about 20% to about 40%, and the percentage of straight bristles 11 may range from about 60% to about 80%. In an exemplary embodiment, the bundle 10 of bristles 11 may have about 30% of undulating bristles 11 and about 70% of straight bristles 11.

In some exemplary embodiments, at least one of the bristles 11 may have a non-circular cross-section. For example, one or more bristles 11 in the bundle 10 may include at least one capillary groove. In an exemplary embodiment, the bristles 11 may be be twisted. By way of example only, the bristles 11 may include at least one helical groove.

Figure 12:
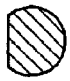
FIGS. 12 to 28 are schematic cross-sectional views of a bristle, illustrating various examples of bristle cross-sections.
Figure 13:
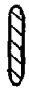
Figure 14:
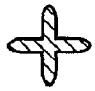
Figure 15:
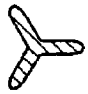
Figure 16:
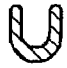
Figure 17:
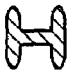
Figure 18:
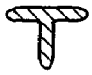
Figure 19:
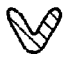
Figure 20:
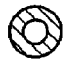
Figure 21:
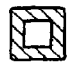
Figure 22:
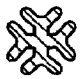
Figure 23:
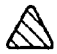
Figure 24:
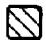
Figure 25:
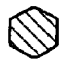
Figure 26:
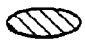
Figure 27:
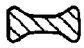
Figure 28:
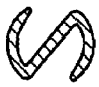
Figure 29:
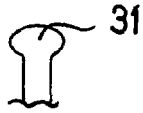
FIGS. 29 to 33 are partial schematic views of a bristle end, illustrating various examples of bristle ends.
Figure 30:
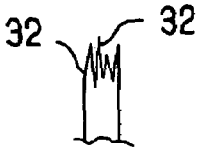
Figure 31:
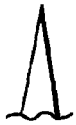

The bristles 11 may comprise a cross-section having any one of the shapes shown diagrammatically in FIGS. 12 to 27: a circular shape with a flat side as shown in FIG. 12; a flat shape as shown in FIG. 13; a star shape, e.g. in the form of a cross as shown in FIG. 14, or having three branches as shown in FIG. 15; a U-shape as shown in FIG. 16; an H-shape as shown in FIG. 17; a T shape as shown in FIG. 18; a V shape as shown in FIG. 19; a hollow shape, e.g. a circular shape as shown in FIG. 20 or a polygonal shape, such as a square shape, as shown in FIG. 21; a shape that presents ramifications as shown in FIG. 22; a solid polygonal shape, e.g. a triangular shape as shown in FIG. 23, a square shape as shown in FIG. 24, or a hexagonal shape as shown in FIG. 25; an oblong shape, e.g. a lens shape, as shown in FIG. 26; or an hourglass shape as shown in FIG. 27. It may be also possible to use bristles 11 having portions hinged relative to one another as shown in FIG. 28.

Where appropriate, the bristles 11 may be subjected to one or more special treatments. For example, the bristles 11 may be subjected to a heat treatment to form, for example, end balls 31, as shown in FIG. 29, or to a mechanical treatment to form end forks 32, as shown in FIG. 30. The bristles 11 may have tapering tips, as shown in FIG. 31.

Figure 32:
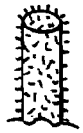
Figure 33:
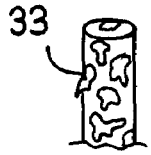

In an exemplary embodiment, the bristles 11 may comprise one or more flocked bristles 11, as shown in FIG. 32. In another exemplary embodiment, the bristles 11 may be made by extruding a plastic material containing a filler of particles 33, as shown in FIG. 33. The filler of particles 33 may increase the roughness of the bristle 11 and thereby improve its substance-retention capability, for example. Where appropriate, the bristles 11 may have magnetic properties and/or any other suitable properties known in the art. The bristles 11 may be made, at least partially, of synthetic materials selected, for example, from: polyolefins such as polyethylene; polyamides such as PA6, PA6/6, PA6/10, PA6/12, or PA11 (e.g. Rilsan®); the polymer Hytrel-Pebax; and any other thermoplastic polymers.

At least some of the bristles 11 may be made of a material having properties that may enhance or facilitate sliding capability. For example, the bristles 11 may be made of Rilsah® or PA6/12 containing, but not limited to, molybdenum disulphide, graphite, or polytetrafluoroethylene (e.g., Teflon®).

The bristles 11 of the invention are not limited to the various exemplary embodiments described above. For example, a single bristle 11 may be formed of any combination of the materials and/or mechanical properties described above, and the bundle 10 of bristles 11 may comprise any combinations of bristles 11 described above.

Figure 34:
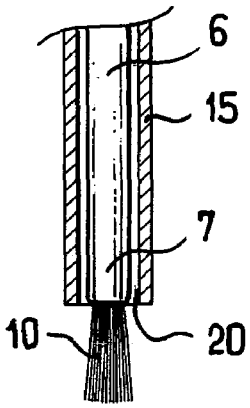
FIG. 34 is a partial cross-sectional view of a device, showing a sheath and a stem.

As mentioned above, the sheath 15 may cooperate with the stem 6 and the bundle 10 of bristles 11 to form the space 20. As shown in, for example, FIG. 3, the space 20 may be defined by a first portion formed between the sheath 15 and the stem 6 and a second portion formed between the sheath 15 and the bristles 11. In a variant, as shown in FIG. 34, the sheath 15 may not extend downwardly beyond the distal end portion 7 of the stem to surround the bundle 10 of bristles 11 and may instead cooperate with only the stem 6 to form the space 20.

Figure 35:
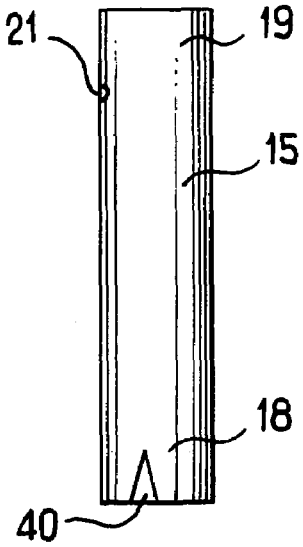
FIG. 35 is a schematic diagram showing a sheath having a notch at its distal end.

As shown in FIG. 35, the sheath 15 may comprise a notch 40, such as, for example, a V-shaped notch, at its bottom portion 18. The notch 40 may permit the substance V to flow onto a predefined region of the bundle 10 of bristles 11.

Figure 6:
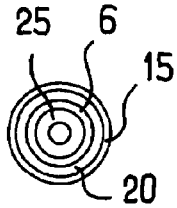
FIG. 6 is a bottom view of the device shown in FIG. 4, viewed from the direction of VI.
Figure 36:
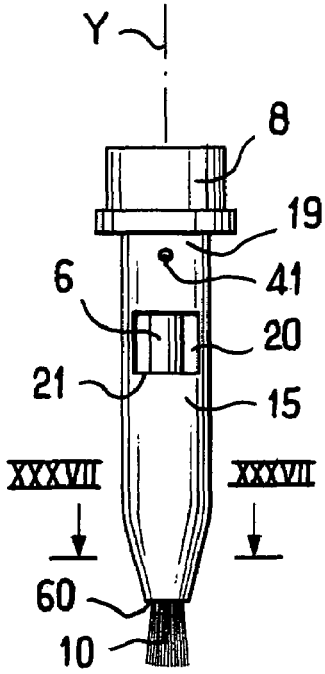
FIG. 36 is an elevation side view of an exemplary device, in which the sheath surrounds the stem.
Figure 37:
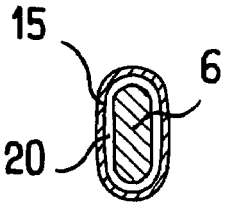
FIG. 37 is a cross-sectional view of the device shown in FIG. 36 along the XXXVII-XXXVII plane.

The cross-section of the stem 6 may be circular, as shown in FIG. 6, and/or it may have, any other shape over at least a fraction of its length. For example, as shown in FIGS. 36 and 37, the stem 6 may comprise a non-circular cross-section (e.g., oblong shape) over at least a fraction of its length from its bottom end. In this exemplary embodiment, the sheath 15 may comprise, at its top portion, a circular cross-section adapted to fix onto the circularly-cylindrical widened portion 26 of the stem 6 and, at its bottom portion, a non-circular cross-section adapted to the shape of the stem 6, as shown in FIG. 37.

Figure 38:
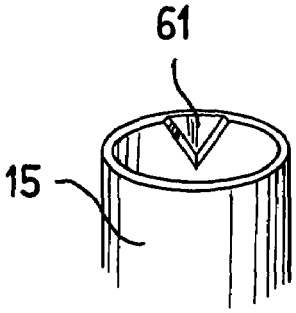
FIGS. 38 and 39 are partial schematic views of an exemplary device, illustrating the stem and the sheath having complementary relief portions.
Figure 39:
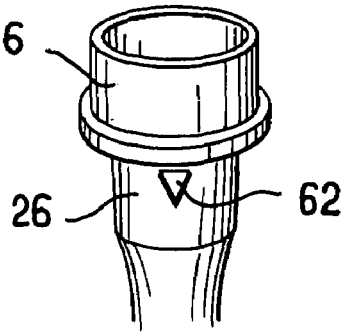

At its bottom end, the sheath 15 may cooperate with the stem 6 and/or the bundle 10 to form a relatively narrow gap 60 that may follow the contour of the stem 6. During application, the width of the gap 60 may vary (e.g., increasing locally) as a result of the bundle 10 of bristles 11 moving and/or as a result of the stem 6 being bent, thereby making it easier for the substance V contained in the space 20 to flow towards the bristles 11 and/or facilitating the flow of the substance V.

Where appropriate, in order to facilitate the angular positioning of the sheath 15 relative to the stem 6 while the sheath 15 is being assembled with the stem 6, the stem 6 and the sheath 15 may be each provided with a relief portion 61, 62, as shown in FIGS. 38, 39. The relief portion 62 of the stem 6 may be in the form of a triangularly-shaped projection projecting from the widened portion 26 of the stem 6, while the relief portion 61 of the sheath 15 may be in the form of a notch that may correspond to the shape of the triangularly-shaped projection of the stem 6. The relief portion 61 of the sheath 15 may open out on its inside surface and on its top end, as shown in FIG. 38. Suitable sealing may be obtained between the applicator 3 and the receptacle 2 by, for example, pressing a cone-shaped portion (e.g., below the plate 90) of the applicator 3 against the neck 4 of the receptacle 2.

Figure 70:
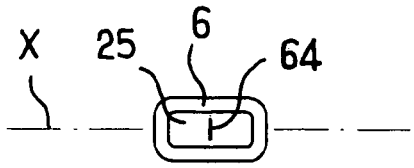
FIGS. 70 and 71 are schematic diagrams of a housing in a stem, illustrating two different ways of positioning a staple to secure the bundle of bristles in the housing.
Figure 71:
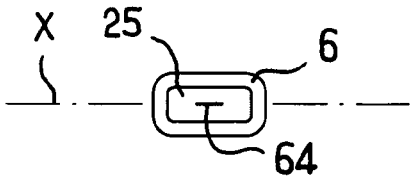

When the housing 25 of the stem 6, which is configured to receive the bundle 10 of bristles 11, is not circularly symmetrical (e.g., a oblong shape), the bundle 10 of bristles 11 may be secured to the housing by a staple 64 that may be oriented substantially perpendicular or parallel to the elongation axis X of the housing 25, as shown in FIGS. 70 and 71, respectively. It should be understood, however, that the staple 64 may be oriented in any other direction. The orientation of the staple 64 in the housing 25 may affect the divergence angle of the bundle 10.

Figure 40:
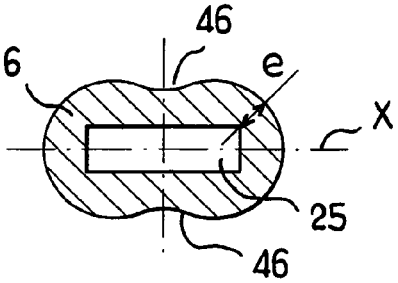
FIG. 40 is a cross-sectional view of an exemplary stem, showing two external depressions.

As shown in FIGS. 40 to 48, the stem 6 may comprise, over at least a fraction of its length (e.g., over its end portion 7), at least one depression 46. The housing 25 may comprise a rectangular cross-section that may be elongated along the axis X, as shown in FIG. 40. The material thickness e of the stem 6 surrounding the housing 25 may not be constant. In some exemplary embodiments, the stem 6 may include two depressions 46 that are diametrically disposed from one another, as shown in, for example, FIG. 40. The depression 46 may provide a channel for the substance to flow to a middle region of the applicator element.

Figure 41:
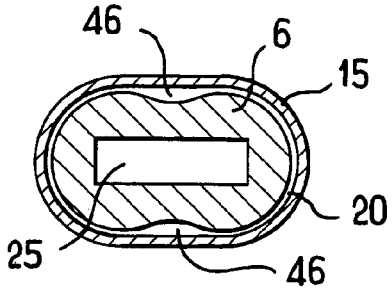
FIG. 41 is a cross-sectional view of an example including a stem and a sheath, showing the sheath surrounding the stem.

FIG. 41 shows the sheath 15 cooperating with the stem 6 to form a space 20 over the entire periphery of the stem 6. The space 20 may have a dimension (e.g., the width of the gap between the outside surface of the stem 6 and the inside surface of the sheath 15) which varies over the entire length of the periphery of the stem 6. For example, as shown in FIG. 41, the dimension of the space 20 maybe greater at the locations where the depressions 46 are formed, thereby enabling the applicator element to hold a greater amount of substance at these locations. Away from the depressions 46, the outline of the stem 6 may have a convex shape.

It should be understood that the shape of the housing 25 and/or the shape of the end portion 7 of the stem 6 (e.g., where the housing 25 is formed) may be modified.

Figure 42:
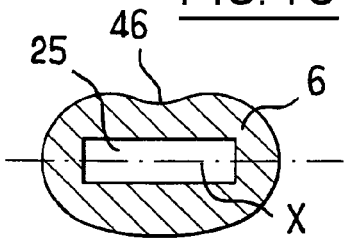
FIGS. 42 to 48 are cross-sectional views of a stem similar to FIG. 40, showing other exemplary cross-sectional shapes of a stem.
Figure 43:
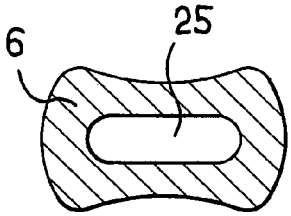
Figure 44:
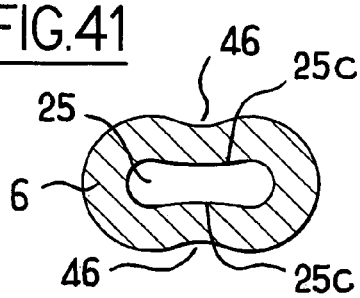

By way of example only, FIGS. 42 to 54 show various shapes of end portions 7 of the stem 6. FIG. 42 shows that the stem 6 may include a single depression 46. FIG. 43 shows that the opening of the housing 25 may have a cross-sectional shape that is not rectangular. In this exemplary embodiment, the housing 25 has a substantially elliptical cross-sectional shape. Alternatively, the housing 25 may have a substantially elliptical cross-sectional shape with two outwardly-facing shallow depressions 25C on its longer sides, as shown in FIG. 44. The depression depths of the two depressions 25C may be less pronounced than the depressions 46 formed at the outside of the stem 6.

Figure 45:
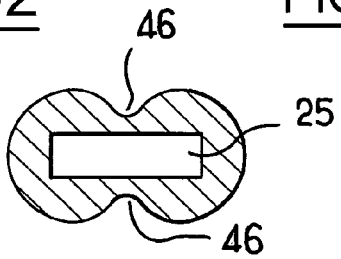
Figure 46:
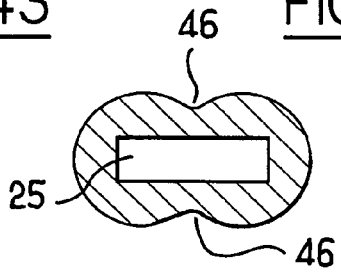

As shown in FIG. 45, the depressions 46 may be relatively narrow, for example, so as to further improve the channeling of the substance. The depressions 46 may also have a substantially triangular cross-sectional profile, as shown in FIG. 46.

Figure 47:
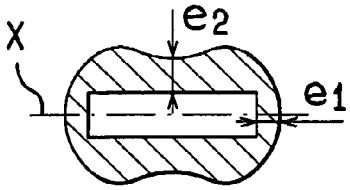
Figure 48:
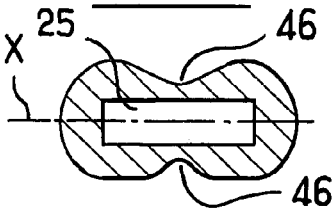

FIG. 47 shows the material thicknesses $e_1$, $e_2$ of the housing 25 at the vicinity of the longitudinal ends of the housing 25 and at a location substantially midway along the housing 25 (e.g., where the depressions are formed). In this exemplary embodiment, the thickness $e_1$ at the vicinity of the longitudinal ends of the housing 25 may be less than the thickness $e_2$ at the location substantially midway along the housing 25. If desired, the thickness $e_1$ may correspond to a minimum thickness of the housing 25. A small thickness $e_1$ may enable the housing 25 to be made longer along the elongation axis X, thereby making it possible to form a brush having a wide width or widening capability. FIG. 48 shows the possibility of having depressions 46 of different shapes.

Regardless of whether one or more depressions 46 are present, the end portion 7 of the stem 6 may have various cross-sectional shapes of the housing 25 for receiving the bundle 10 of bristles 11. By way of examples, FIGS. 49 to 54 show various exemplary cross-sectional shapes for the end portion 7 of the stem 6 including the housing 25.

Figure 49:
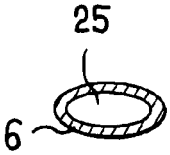
FIGS. 49 to 54 are schematic cross-sectional views of a stem, showing exemplary shapes of a housing configured to receive a bundle of bristles.
Figure 50:
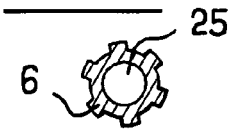
Figure 51:
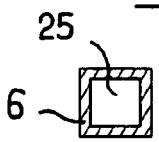
Figure 52:
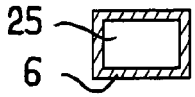
Figure 53:
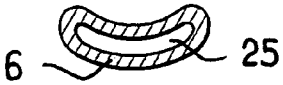
Figure 54:
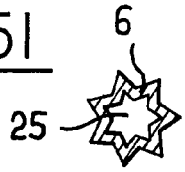

For example, the end portion 7 of the stem 6 may have an oval or elliptical cross-sectional shape, as shown in FIG. 49. The cross-sectional shape may be polygonal, such as, for example, a square or rectangle, as shown in FIGS. 51 and 52, respectively. The cross-sectional shape may also be kidney-shaped, as shown in FIG. 53, star-shaped, as shown in FIG. 54, or crenellated, as shown in FIG. 50.

Figure 57:
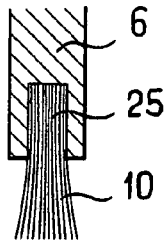
Figure 56:
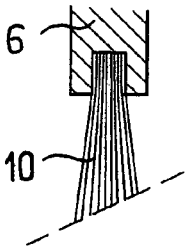

According to some exemplary embodiments of the invention, the length of the bristles 11 in a bundle 10 may be selected such that the free ends of the bristles 11 may be arranged substantially in a single plane. For example, the free ends of the bristles 11 may be arranged substantially in a plane that is substantially perpendicular to the longitudinal axis Y of the stem 6, as shown in FIG. 57. In an alternative embodiment, the free ends of the bristles 11 may be arranged in a plane that forms an inclined angle with respect to the longitudinal axis Y of the stem 6, as shown in FIG. 56.

Figure 55:
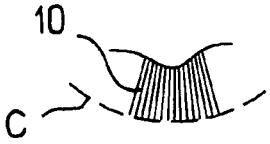
FIGS. 55 to 58 are schematic diagrams illustrating various different end profiles of a bundle of bristles.

In a variant, the free ends of the bristles 11 may be situated along a non-planar surface C. For example, the free ends of the bristles 11 may be substantially aligned along a convex surface, as shown in FIG. 55.

Figure 58:
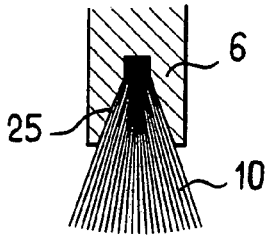

In an exemplary embodiment, the housing 25 may have a constant cross-section, as shown in FIG. 57. With the constant cross-section, it may be possible to form a brush having bristles that are relatively close together. Conversely, by making the housing 25 diverge outwardly, as shown in FIG. 58, the bristles 11 may spread further apart from one another and form a wider bundle 10.

Figure 60:
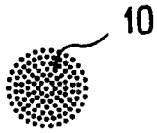
FIGS. 59 to 61 are schematic diagrams showing some exemplary cross-sectional shapes of bristle bundles.
Figure 59:
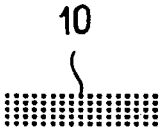
Figure 61:
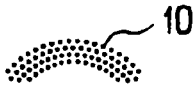

In various exemplary embodiments, the bundle 10 of bristles 11 may have different cross-sectional shapes. For example, as shown in FIG. 59, the bundle 10 may have a flat cross-sectional shape. Alternatively, the bundle 10 may have a round cross-section, as shown in FIG. 60, or a curved cross-section, as shown in FIG. 61. Various other shapes of the bundle 10 may be possible depending on, for example, the shape of the body part to which substance is to be applied with the bundle 10. For example, the bundle 10 having a curved cross-sectional shape of FIG. 61 may present a better fit to the curvature of a nail.

Figure 62:
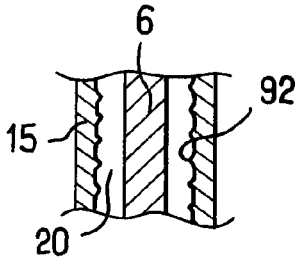
FIG. 62 is a partial schematic diagram showing a sheath with relief portions formed on its inside surface.

As shown in FIG. 62, the sheath 15 may form one or more relief portions 92 on its inside surface. In an exemplary embodiment, the relief portions 92 may be annular ribs.

Figure 63:
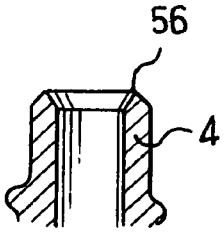
FIGS. 63 and 64 are partial cross-sectional views showing various exemplary embodiments of a neck of a receptacle.

The neck 4 of the receptacle 2 may include a free edge at its top end. The free edge may be flat or have a sharp edge 56, as shown in FIG. 63. The presence of a sharp edge 56 may enhance sealing of the receptacle 2 by bringing the sharp edge 56 into contact with a bottom surface 57 of the plate 90 in the endpiece 8 of the stem 6. In addition, if the receptacle 2 does not include a wiper, the sharp edge 56 may serve a function of a wiper. For example, the user may wipe the bundle 10 carrying substance against the free edge 56 of the neck 4 when removing the applicator 3 from the receptacle 2 to remove excessive amount of substance from the bundle 10. Because of the sharp edge 56, the substance may easily flow down into the receptacle 2. The sharp edge 56 may have various shapes.

Figure 69:
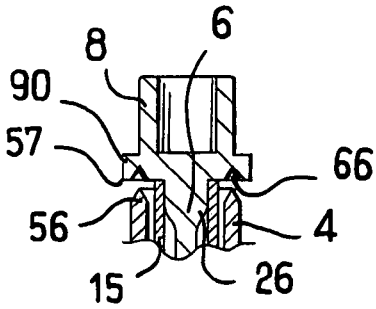
FIG. 69 is a partial cross-sectional view of an exemplary device, showing a variant embodiment of the stem.

In some exemplary embodiments, the bottom surface 57 of the plate 90 in the endpiece 8 of the stem 6 may form a groove 66 to receive the free edge (e.g., the sharp edge 56) of the neck 4, as shown in FIG. 69. This engagement between the free edge of the neck 4 and the groove 66 of the plate 90 may further improve the sealing of the receptacle 2 when the applicator is in a closed position.

Figure 64:
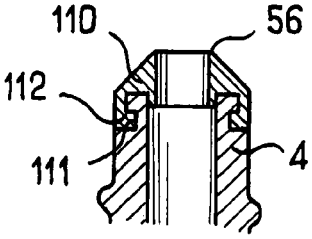

In a variant, as shown in FIG. 64, the sharp edge 56 may be formed on an add-on piece 110 that may be fixed to the neck 4 of the receptacle 2. The add-on piece 110 may be secured to the neck 4 by snap-fastening. For example, the neck 4 may include an outer annular groove 111, and the add-on piece 110 may include a corresponding inwardly-directed flange 112 configured to engage the annular groove 111 of the neck 4. It should be understood that any other securing mechanism (e.g., interference-fitting, screw-fastening, gluing, welding, etc.) may be used to secure the add-on piece 110 to the neck 4. In an exemplary embodiment, the add-on piece 110 may be made of plastic material.

Figure 65:
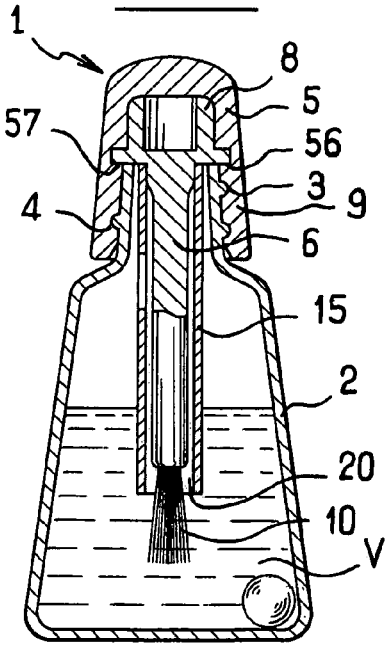
FIGS. 65 and 66 are schematic diagrams showing other exemplary embodiments of devices for applying a substance.
Figure 66:
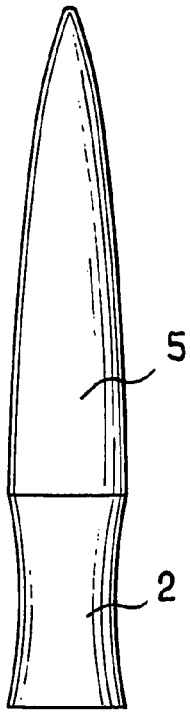

The receptacle 2 containing the substance V to be applied may have a variety of different shapes. For example, as shown in FIG. 65, the receptacle 2 may have a conventional shape. In an alternative embodiment, the receptacle 2 may have a waist section that tapers in towards its center, as shown in FIG. 66. This configuration may facilitate holding of the receptacle 2. In some exemplary embodiment, the receptacle 2 may contain a ball used for homogenizing the substance V.

Alternatively or additionally, the waist section may have a sleeve formed of, for example, an elastomer sleeve that may be fitted onto the receptacle 2. The sleeve may be substantially cylindrical, for example.

The closure cap 5 may also have a variety of different shapes. For example, the closure cap 5 may have a substantially conical shape, as shown in FIG. 66.

Figure 67:
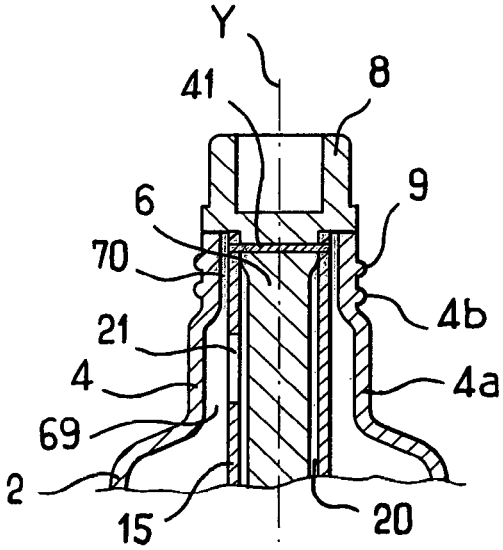
FIG. 67 is a partial cross-sectional view of an exemplary device, illustrating the possibility of making the receptacle with a widened neck.

According to another exemplary embodiment, the neck 4 may include a shoulder having a widened portion that may provide an additional space between the inside surface of the receptacle 2 and the sheath 15 at or near the location of the lateral opening 21. For example the neck 4 may have a widened bottom portion 4*a* which may cooperate with the sheath 15 to form an annular space 69 that may be wider than the annular space 70 between the, sheath 15 and the thread-carrying top portion 4*b*, as shown in FIG. 67. This may make it easier to fill the space 20 with the substance penetrating through the opening 21. By way of example only, the width of the additional space 70 may be greater than 1.5 mm.

In use, the substance V may reach the lateral opening 21 of the sheath 15 through the space 69 by, for example, shaking the receptacle 2 up and down, tilting the receptacle 2, or placing the receptacle 2 on an up-side down position.

Figure 68:
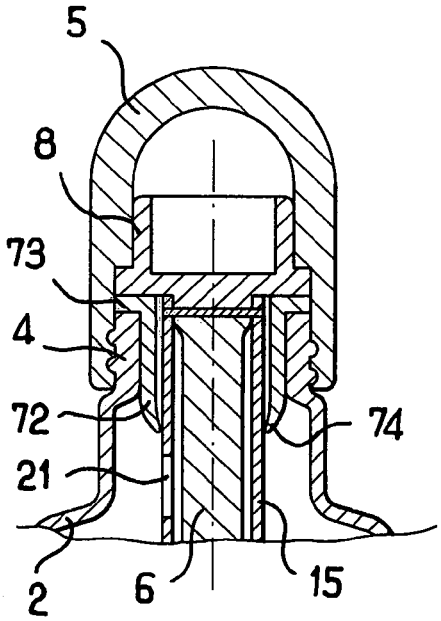
FIG. 68 is a partial cross-sectional view of an exemplary device, illustrating the possibility of providing the receptacle with a wiper member.

The receptacle 2 may include a wiper member 72. For example, as shown in FIG. 68, a wiper member 72 may be inserted into the neck 4. The wiper member 72 may bear against the top end of the neck 4 via a rim 73. The wiper member 72 may include an annular lip 74 that may come to bear against the outside surface of the sheath 15 above the lateral opening 21 when the receptacle 2 is in a closed position.

Figure 73:
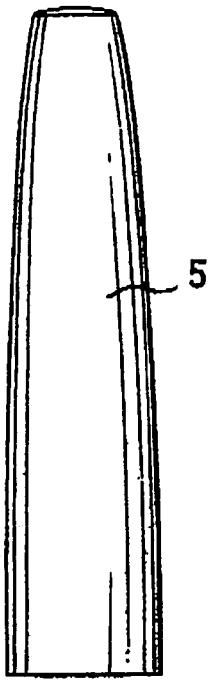
FIG. 73 is a schematic diagram showing an example of a closure cap.
Figure 74:
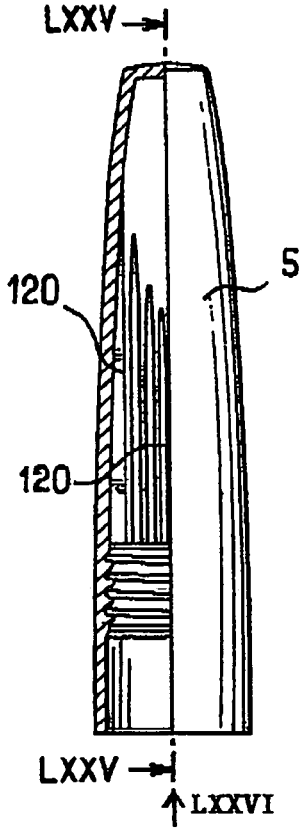
FIG. 74 is a fragmentary view of the cap shown in FIG. 73.
Figure 75:
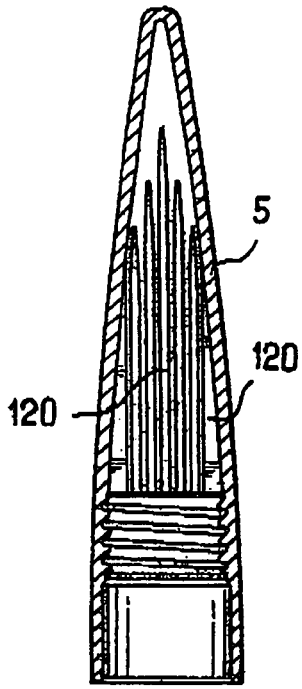
FIG. 75 is a diagrammatic cross-sectional view of the cap shown in FIG. 74, along the LXXV-LXXV plane.
Figure 76:
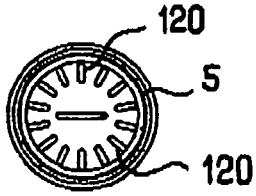
FIG. 76 is a bottom view of the cap shown in FIG. 74, viewed in the direction of LXXVI.

The closure cap 5 may have an elongate shape with a substantially flat top end, as shown in FIGS. 73 to 75. As shown in the figures, the inside surface of the cap 5 may include a plurality of fins 120 of different lengths. The fins 120, shown in FIGS. 74 to 76, may facilitate securing of the cap 5 onto the endpiece 8 by increasing the friction therebetween.

Figure 77:
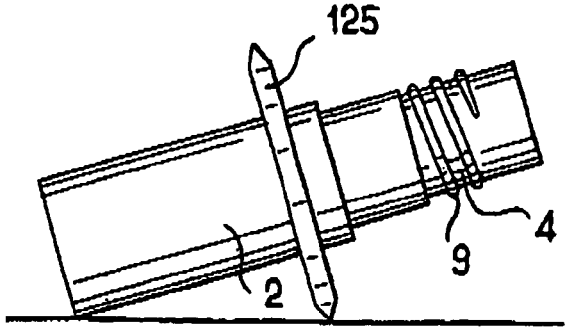
FIG. 77 is a schematic side view, showing a variant embodiment of the receptacle.

The receptacle 2 may be provided, on its outside surface, with a ring 125 that may be fixed on the receptacle 2 by, for example, friction-fitting, as shown in FIG. 77. In an exemplary embodiment, the ring 125 may be formed of an elastomeric material. The ring 125 may facilitate holding of the receptacle 2. The ring 125 may also permit the receptacle 2 to be placed laterally on a horizontal surface without the substance contained in the receptacle 2 flowing out of the receptacle 2.

Figure 72:
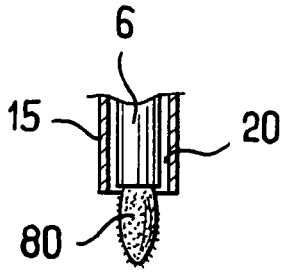
FIG. 72 is a partial schematic view, showing another applicator element.

Although the invention has been described in connection with applicator brushes, the invention may also be applied to any other types of applicator elements, such as, for example, a flocked tip 80, a foam tip, or a felt tip, as shown in FIG. 72.

Figure 78:
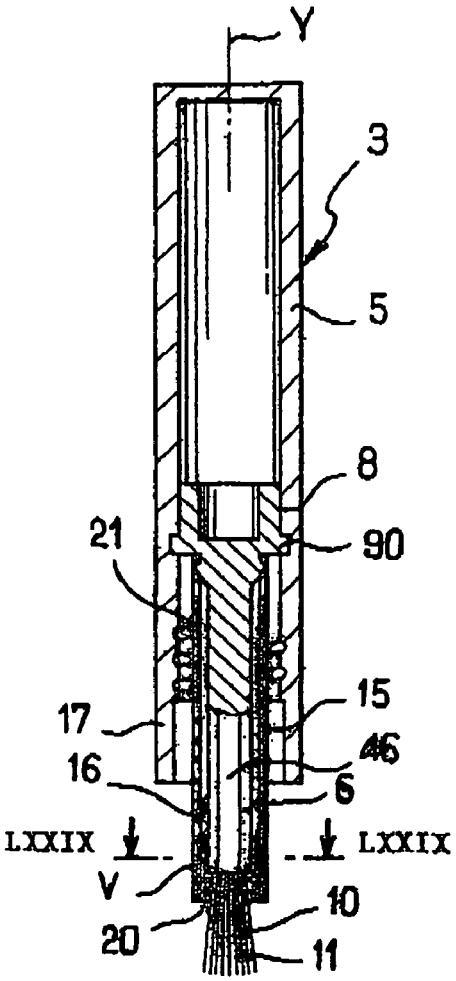
FIG. 78 is a cross-sectional view similar to FIG. 2, showing a variant embodiment.
Figure 79:
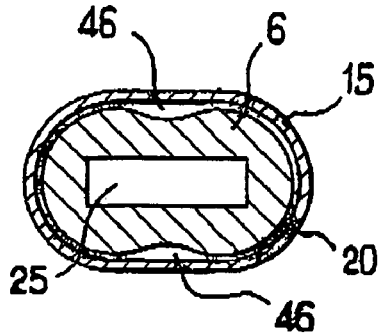
FIG. 79 is a cross-sectional view of the device shown in FIG. 78 along the LXXIX-LXXIX plane.

Referring to FIGS. 78 and 79, an applicator may include a stem 6 provided with at least one depression 46 and a bundle 10 of bristles 11 that may be of any type, e.g. rectilinear and/or circular cross-section. FIG. 78 also shows the sheath 15 secured to the stem 6 by snap-fastening.

In the embodiment shown in FIGS. 78 and 79, the stem 6 may include two opposite longitudinal grooves or depressions 46. In another exemplary embodiment, the stem 6 may include only one groove 46. In still another exemplary embodiment, the stem 6 may include at least one non-rectilinear groove, such as, for example, a helical groove. In general, the stem 6 may have any one of the exemplary embodiments described above with reference to FIGS. 40 to 48.

Figure 80:
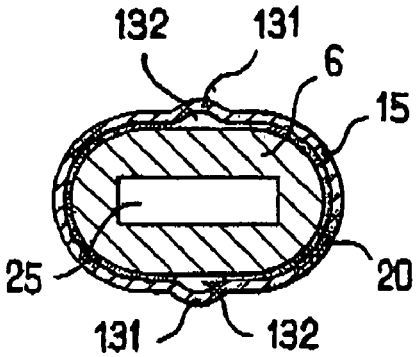
FIG. 80 is a cross-sectional view similar to FIG. 79 showing a variant embodiment.

The stem 6 and the sheath 15 may also have any other shapes, making it possible to vary the dimension of the space 20 between the stem 6 and the sheath 15. For example, as shown in FIG. 80, the sheath 15 may form at least one groove 131 (e.g., two grooves 131) in its radial inner surface to create a depression 132 in the space 20. In this embodiment, the outside surface of the stem 6 may define a contour that may not have any depression in its cross-section. In a variant, both the sheath 15 and the stem 6 may have respective depressions in their cross-sections.

Figure 81:
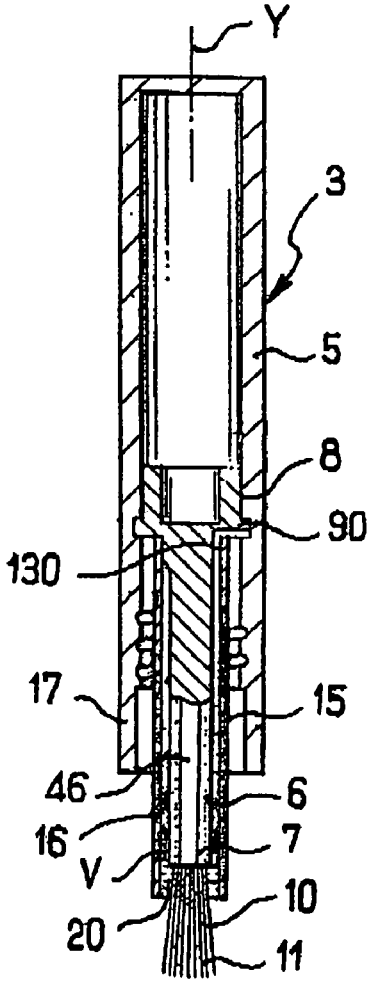
FIG. 81 is a cross-sectional view similar to FIG. 78 showing another variant embodiment.

The air in the space 20 between the sheath 15 and the stem 6 may be vented out by any means other than by passing through lateral openings 21. For example, as shown in FIG. 81, the sheath 15 may not include any lateral opening. Instead, the stem 6 may include a notch extending both axially between the sheath 15 and the stem 6 and radially below the plate 90 and above the top edge of the sheath 15, forming a vent 130 that enables air to be vented out of the space 20 when the bottom end of the sheath 15 is immersed in the substance.

Figure 82:
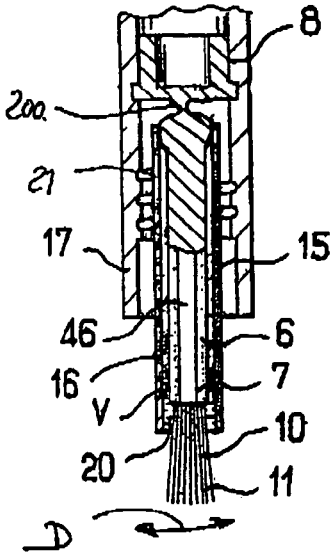
FIG. 82 is a partial cross-sectional view of a device, showing another variant embodiment.

The applicators 3 may include a hinge 82, as shown in FIG. 82. The hinge 82 may enhance the flexibility of the stem 6 and the sheath 15 (e.g., enhanced angular movement) so as to improve the applicator comfort during application. In an exemplary embodiment, the hinge 200 may be a film hinge. In another exemplary embodiment, the hinge 200 may constitute a restricted portion of the stem 6 in the form of, for example, a wire shape or an hourglass shape. The restricted portion may be connected to the endpiece 8. In still another exemplary embodiment, the hinge 200 may be made of a ball and a socket with one or more pivot axes.

In the embodiment shown in FIG. 82, the sheath 15 may be fixed to the stem 6 below the hinge 200 and may pivot with the stem 6.

The invention is not limited to the embodiments described above, and the characteristics and/or features of the various different embodiments may be combined. For example, the bundle 10 of bristles 11 can be replaced by any of the applicator elements described with reference to, for example, FIGS. 1, 8, 34, 36, 65, 66, 67, and 68.

Throughout the description, including in the claims, the term "comprising a" should be understood as being synonymous with the term "comprising at least one" (i.e., relating to both the singular and the plural) unless otherwise specified to the contrary.

It will be apparent to those skilled-in the art that various modifications and variations can be made to the structure of the present invention. Thus, it should be understood that the invention is not limited to the examples discussed in the specification. Rather, the present invention is intended to cover modifications and variations.

What is claimed is:

1. An applicator for applying a substance, comprising:

a bundle of bristles comprising at least one of bristles of at least two kinds, bristles of non-circular cross-section, and bristles that are not rectilinear;

a stem supporting the bundle of bristles; and a sheath cooperating with the stem over at least a fraction of a length of the stem to form a space configured to contain a portion of a substance to be applied;

wherein the stem is fixed axially with respect to the sheath.

2. An applicator according to claim 1, wherein the bundle of bristles comprises at least two bristles comprising compositions that are different from one another.

3. An applicator according to claim 1, wherein the bundle of bristles comprises at least two bristles having dimensions that are different from one another.

4. An applicator according to claim 3, wherein the bundle of bristles comprises at least two bristles having lengths and/or greatest transverse dimensions that are different from one another.

5. An applicator according to claim 3, wherein one of the at least two bristles has a length more than 10% greater than a length of another of the at least two bristles.

6. An applicator according to claim 3, wherein one of the at least two bristles has a greatest transverse dimension more than 15% greater than a greatest transverse dimension of another of the at least two bristles.

7. An applicator according to claim 1, wherein the bundle of bristles comprises at least two bristles having shapes that are different from one another.

8. An applicator according to claim 7, wherein one of the at least two bristles has a longitudinal profile that is different from a longitudinal profile of another of the at least two bristles.

9. An applicator according to claim 7, wherein one of the two bristles has a cross-section that is different from a cross-section of another of the at least two bristles.

10. An applicator according to claim 7, wherein the bundle of bristles comprises at least one straight bristle and at least one undulating bristle.

11. An applicator according to claim 10, wherein a percentage of straight bristles in the bundle ranges from about 60% to about 80%, and a percentage of undulating bristles in the bundle ranges from about 20% to about 40%.

12. An applicator according to claim 10, wherein the percentage of straight bristles in the bundle is about 70%.

13. An applicator according to claim 10, wherein the percentage of undulating bristles in the bundle is about 30%.

14. An applicator according to claim 1, wherein each of the at least two kinds of bristles has a number of bristles representing at least 2% of the total number of bristles in the bundle.

15. An applicator according to claim 1, wherein the sheath cooperates with the stem only to form the space.

16. An applicator according to claim 1, wherein the sheath cooperates with both the bundle of bristles and the stem to form the space.

17. An applicator according to claim 1, wherein the sheath includes at least one lateral opening enabling a fluid communication between the space and an outside of the sheath.

18. An applicator according to claim 17, wherein the opening extends over at least about 9 $mm^2$.

19. An applicator according to claim 17, wherein the opening extends over at least about 16 $mm^2$.

20. An applicator according to claim 17, wherein the opening extends over at least about 20 $mm^2$.

21. An applicator according to claim 17, wherein the opening extends over at least about 25 $mm^2$.

22. An applicator according to claim 1, wherein the space is arranged such that the substance is retained in the space by capillarity.

23. An applicator according to claim 1, wherein the sheath is rigid.

24. An applicator according to claim 1, wherein the sheath is flexible.

25. An applicator according to claim 1, wherein the sheath is made of a material that is different from a material of the stem.

26. An applicator according to claim 1, wherein the sheath is made of the same material as the stem.

27. An applicator according to claim 1, wherein the sheath comprises an inside surface that is completely smooth.

28. An applicator according to claim 1, wherein the sheath comprises an inside surface that includes at least one relief portion.

29. An applicator according to claim 1, wherein the sheath is secured to the stem by stapling.

30. An applicator according to claim 1, wherein the sheath is attached to the stem by snap-fastening.

31. An applicator according to claim 1, wherein the sheath comprises a circular cross-section.

32. An applicator according to claim 1, wherein the sheath comprises an oblong cross-section over at least a fraction of its length.

33. An applicator according to claim 1, wherein the sheath comprises a notch at a free end.

34. An applicator according to claim 1, wherein at least a portion of the stem adjacent to the bundle of bristles comprises a cross-section having an outer profile that includes at least one depression.

35. An applicator according to claim 1, wherein the stem comprises a housing configured to receive the bundle of bristles, and the bundle of bristles is secured to the housing, the housing having an opening of oblong cross-section with a long axis, the oblong cross-section having a depression substantially mid-way along the long axis of the housing.

36. An applicator according to claim 1, wherein the stem comprises two depressions situated opposite each other.

37. An applicator according to claim 1, wherein the sheath comprises an inside cross-section that varies.

38. An applicator according to claim 37, wherein the sheath comprises an inside cross-section that is circular at one axial end and that is flat at the other axial end.

39. An applicator comprising:

an applicator element;

a stem supporting the applicator element; and a sheath cooperating with the stem over at least a fraction of a length of the stem to form a space configured to contain at least a portion of a substance to be applied, the sheath and the stem comprising cross-sections arranged such that the space defines a width that varies around the stem over at least a fraction of the length of the stem, wherein the sheath includes at least one lateral opening enabling a fluid communication between the space and an outside of the sheath.

40. An applicator according to claim 39, wherein the cross-sections of the sheath and the stem are different from one another so that the width of the space between the sheath and the stem varies around the circumference.

41. An applicator according to claim 39, wherein at least a portion of the stem adjacent to the applicator element comprises a cross-section having an outer profile that comprises at least one depression.

42. An applicator according to claim 41, wherein the stem comprises at least one rectilinear groove extending along at least a fraction of the stem.

43. An applicator according to claim 41, wherein the stem comprises two rectilinear grooves situated opposite to each other.

44. An applicator according to claim 41, wherein the sheath comprises the at least one depression at least in the vicinity of an end of the sheath adjacent to the applicator element.

45. An applicator according to claim 39, wherein the cross-section of the sheath comprises at least one depression.

46. An applicator according to claim 39, wherein the stem or the sheath comprises a groove, the groove opening out axially at the end of the stem or the sheath adjacent to the applicator element.

47. An applicator according to claim 39, wherein the stem or the sheath comprises a cross-section having at least one depression, the shape of the at least one depression varying along the length of the stem or the sheath.

48. An applicator according to claim 39, wherein the stem comprises a wall of varying thickness around a housing of the stem, the housing being configured to receive the applicator element.

49. An applicator according to claim 39, wherein the stem comprises a wall of constant thickness around a housing of the stem, the housing being configured to receive the applicator element.

50. A device for applying a substance, the device comprising a receptacle containing the substance to be applied, and an applicator as defined in claim 39.

51. A device according to claim 50, wherein the substance contained in the receptacle is a product to be applied to nails.

52. A device for applying a substance, the device comprising a receptacle containing the substance to be applied, and an applicator as defined in claim 1.

53. A device according to claim 52, further comprising a closure cap supporting the stem, wherein the receptacle comprises a neck configured to engage the closure cap.

54. A device according to claim 53, wherein the length of the closure cap is greater than the length of the stem.

55. A device according to claim 53, wherein the closure cap comprises a plurality of fins disposed on an inside surface of the closure cap.

56. A device according to claim 52, wherein the device lacks a wiper.

57. A device according to claim 52, further comprising a wiper.

58. A device according to claim 52, wherein the receptacle comprises a neck comprising a free edge forming a sharp edge.

59. A device according to claim 52, wherein the receptacle comprises a neck and an add-on piece associated with the neck, the add-on piece forming a sharp edge.

60. A device according to claim 59, wherein the add-on piece is secured to the neck of the receptacle by snap-fastening.

61. A device according to claim 52, wherein the sheath comprises at least one lateral opening having an area greater than 9 $mm^2$, and wherein the receptacle comprises a neck having an at least partially widened portion in the vicinity of the lateral opening, so as to make it easier for the substance to flow towards the lateral opening.

62. A device according to claim 61, wherein the distance between the lateral opening and a wall of the widened portion is not less than 1.5 mm.

63. A device according to claim 52, wherein the sheath defines a radial clearance relative to the receptacle when the applicator is in place on the receptacle, the clearance being not less than 0.5 mm.

64. A device according to claim 63, wherein a top end of the sheath comprises an outside diameter that is less than an inside diameter of a neck of the receptacle.

65. A device according to claim 52, further comprising an outer ring secured to an outside surface of the receptacle.

66. A device according to claim 52, wherein a vent is formed between a top edge of the sheath and a portion of the applicator to which the sheath is secured.

67. A device according to claim 52, wherein the substance contained in the receptacle is a product to be applied to nails.

68. An applicator for applying a substance, comprising:

a bundle of bristles comprising at least one of bristles of at least two kinds, bristles of non-circular cross-section, and bristles that are not rectilinear;

a stem supporting the bundle of bristles; and a sheath cooperating with the stem over at least a fraction of a length of the stem to form a space configured to contain a portion of a substance to be applied;

wherein the sheath has a free end portion having an opening; and wherein an interior of the free end portion does not taper toward the opening.

69. An applicator for applying a substance, comprising:

a bundle of bristles comprising at least one of bristles of at least two kinds, bristles of non-circular cross-section, and bristles that are not rectilinear;

a stem supporting the bundle of bristles; and a sheath cooperating with the stem over at least a fraction of a length of the stem to form a space configured to contain a portion of a substance to be applied;

wherein the bundle of bristles comprises at least one straight bristle and at least one undulating bristle; and wherein a percentage of straight bristles in the bundle ranges from about 60% to about 80%, and a percentage of undulating bristles in the bundle ranges from about 20% to about 40%.

70. An applicator for applying a substance, comprising:

a bundle of bristles comprising at least one of bristles of at least two kinds, bristles of non-circular cross-section, and bristles that are not rectilinear;

a stem supporting the bundle of bristles; and a sheath cooperating with the stem over at least a fraction of a length of the stem to form a space configured to contain a portion of a substance to be applied;

wherein the sheath is secured to the stem by stapling.

* * * * *